US006943747B2

(12) United States Patent
Kwon

(10) Patent No.: US 6,943,747 B2
(45) Date of Patent: Sep. 13, 2005

(54) SMALL AND OMNI-DIRECTIONAL BICONICAL ANTENNA FOR WIRELESS COMMUNICATIONS

(75) Inventor: Do-Hoon Kwon, Seoul (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 1 day.

(21) Appl. No.: 10/652,027

(22) Filed: Sep. 2, 2003

(65) Prior Publication Data

US 2004/0041736 A1 Mar. 4, 2004

(30) Foreign Application Priority Data

Sep. 2, 2002 (KR) ..... 10-2002-0052463

(51) Int. Cl.[7] ..... H01Q 13/10
(52) U.S. Cl. ..... 343/773; 343/774
(58) Field of Search ..... 343/773, 786, 343/846, 772, 774, 769, 808, 874

(56) References Cited

U.S. PATENT DOCUMENTS 2,596,190 A 5/1952 Wiley
2,599,896 A 6/1952 Clark et al.
5,889,497 A 3/1999 Brooker et al.
5,923,299 A * 7/1999 Brown et al. ..... 343/773
6,268,834 B1 * 7/2001 Josypenko ..... 343/773
6,346,920 B2 * 2/2002 Sharp et al. ..... 343/773

FOREIGN PATENT DOCUMENTS

WO WO 95/32529 11/1995
WO WO9532529 * 11/1995 ..... 343/773

* cited by examiner

*Primary Examiner*—Don Wong
*Assistant Examiner*—Minh Dieu A
(74) *Attorney, Agent, or Firm*—Lee & Morse, P.C.

(57) ABSTRACT

A biconical antenna for wireless communications includes a conical upper conductive body and a conical lower conductive body having a common apex, which is used as a power feed point, wherein a space between the conical upper and lower conductive bodies is filled with a dielectric material such that a shortest distance connecting the conical upper and lower conductive bodies along a surface of the dielectric material is a curve at which an incident angle of an incident wave incident on the surface of the dielectric material through the dielectric material from the common apex is a Brewster angle over the entire surface of the dielectric material.

14 Claims, 7 Drawing Sheets

SMALL AND OMNI-DIRECTIONAL BICONICAL ANTENNA FOR WIRELESS COMMUNICATIONS

BACKGROUND OF THE INVENTION

1. Field of the Invention

The present invention relates to an antenna for wireless communications. More particularly, the present invention relates to a small and omni-directional biconical antenna for use in for mobile communications.

2. Description of the Related Art

Wireless communications using an impulse (impulse communications) use a very wide frequency band, as compared to conventional narrow band wireless communications. In addition, impulse communications are known as a communication method enabling high-speed data transmission at a very low electric power. Previously, impulse communications have been applied to the field of radar. In an effort to improve performance of radar, studies have been performed to obtain a wide band operation and a high gain in addition to an antenna radiation pattern.

With the rapid development of mobile communications technologies, however, studies regarding the merits of applying impulse communications to the field of mobile communications have been actively undertaken. Even if impulse communications have superior technical merits, impulse communications cannot be applied to mobile communications when impulse communications inconvenience users who use the actual equipment or the equipment is difficult to carry. Thus, a first priority, prior to the application of impulse communications to mobile communications, is to provide a compact antenna for transceiving an impulse, i.e., an impulse antenna.

With the developments of relevant studies, a variety of types of impulse antennas have been suggested. FIGS. 1 through 3 illustrate examples of conventional impulse antennas.

FIG. 1 illustrates a perspective view of a conventional biconical antenna having a wide band feature.

An impulse antenna 10 includes an upper conductive body 11 and a lower conductive body 12 having a common power feed point 13. The upper and lower conductive bodies 11 and 12 are conical. The size of the impulse antenna 10 is designed by considering the minimum wavelength of an impulse in use. The length of the impulse antenna 10, that is, the length between the power feed point 13 and an edge of the impulse antenna 10, is designed to be at least ¼ of the wavelength of the minimum frequency of the impulse. However, since air is present between the upper conductive body 11 and the lower conductive body 12, the length $R_1$ of the upper conductive body 11 and the length $R_2$ of the lower conductive body 12 is more than ¼ of the wavelength in air of the minimum frequency included in the power feed signal.

In FIG. 1 and throughout the figures, angle $\theta_1$ denotes an angle between a Z-axis (not shown) passing through the center of the impulse antenna 10 and the upper conductive body 11. Angle $\theta_2$ denotes an angle between the Z-axis and the lower conductive body 12.

FIG. 2 illustrates a sectional view of an impulse antenna using a transverse electromagnetic (TEM) horn antenna. The impulse antenna shown in FIG. 2 is used for feeding of a pulse radar that is specially designed for a large output of power. A boundary surface 30 is angled with respect to a horizontal axis (not shown) so that a wave incident on the boundary surface 30 can be input at a Brewster angle. For a plane electromagnetic wavefront incident on a plane boundary between two dielectric substances having different refractive indices, a Brewster angle is the angle of incidence at which there is total transmittance from a first dielectric substance to a second dielectric substance.

However, a TEM wave input to the boundary surface 30 from the left side of the drawing is close to a spherical wave, not a plane wave. Accordingly, over the entire boundary surface 30, the incident angle of the TEM wave on the boundary surface 30 does not match the Brewster angle. As a result, a perfect impedance match is not made at the boundary surface 30. Impedance reflection due to the impedance mismatch at the boundary surface 30 increases as a height $H_2$ of the TEM horn antenna increases.

In FIG. 2, reference numeral 1 denotes an electromagnetic wave generator; reference numeral 2 denotes a spark gap; reference numeral 3 denotes a pulser; reference numerals 6 and 14 denote grounded plates; reference numeral 8 denotes a parallel upper plate; reference numerals 10 and 17 denote dielectric materials; reference numerals 12 and 18 denote TEM horns; and reference numeral 16 denotes an upper plate. Further, distances $H_1$ through $H_3$ indicate gaps between the grounded plate 14 and the upper plate 16 in the TEM horn 18, the upper plate 16 and the grounded plate 14 in the TEM horn 12, and the upper plate 8 and the grounded plate 6 in the electromagnetic wave generator 1, respectively. Angles $\psi_1$ and $\psi_2$ indicate angles between the boundary surface 30 and a portion extending from the TEM horn 12 of the grounded plate 14 to the TEM horn 18, and the boundary surface 30 and an extended portion of the upper plate 16, respectively.

FIG. 3 illustrates a sectional view of a conventional biconical antenna 20 in which a dielectric material 33 having a dielectric constant $\in_1$ is used between an upper conductive body 26 and a lower conductive body 24. The dielectric material 33 prevents rain from flowing in along a power feed line when the biconical antenna 20 is used outdoors and simultaneously supports the upper and lower conductive bodies 26 and 24.

In FIG. 3, reference numerals 21, 23, and 24 denote a coaxial feed, a lower support structure, and a lower cone, respectively. Distances $R_1$ and $R_2$ indicate lengths of the upper conductive body 26 and the lower conductive body 24, respectively. Distances L', L", and $L_0$ indicate lengths of an upper portion, a lower portion, and a middle portion of the dielectric material 33, respectively. Angle $\theta_0$ denotes an angle between the Z-axis and the middle portion of the dielectric material 33.

In a case of a conventional impulse antenna, a length of the antenna can be designed to be at least ¼ of the wavelength of the minimum frequency of a usable impulse. However, considering that the wavelength is in air, the size of the conventional impulse antenna is much greater than that of an antenna for a mobile communication terminal. In addition, in the conventional impulse antenna, since the TEM wave cannot be incident on the boundary surface at the Brewster angle, impedance mismatch is generated on the boundary surface, thereby generating an impulse reflection on the boundary surface, thus sharply deteriorating the quality of communication.

SUMMARY OF THE INVENTION

In an effort to solve at least some of the above and/or other problems, the present invention provides a small and omni-directional biconical antenna that can reduce the size of an antenna to facilitate application in a mobile communication terminal and minimize impedance mismatch at a boundary surface.

According to an embodiment of the present invention, a biconical antenna for wireless communications includes a conical upper conductive body and a conical lower conductive body having a common apex, which is used as a power feed point, wherein a space between the conical upper and lower conductive bodies is filled with a dielectric material such that a shortest distance connecting the conical upper and lower conductive bodies along a surface of the dielectric material is a curve at which an incident angle of an incident wave incident on the surface of the dielectric material through the dielectric material from the common apex is a Brewster angle over the entire surface of the dielectric material. Preferably, the curve is a log-spiral curve.

Preferably, a dielectric constant of the dielectric material is between about 4–50. More preferably, the dielectric constant of the dielectric material is about 10. Preferably, the dielectric material is either high-density glass, dielectric ceramic, or engineering plastic.

In a first preferred embodiment, a length of the conical upper conductive body is shorter than a length of the conical lower conductive body. In the first preferred embodiment, the length of the conical upper conductive body is preferably at least $\lambda_0/4$, wherein $\lambda_0$ is a wavelength when a usable impulse is the minimum frequency. In the first preferred embodiment, the conical upper conductive body may be extended beyond the surface of the dielectric material.

In a second preferred embodiment, a length of the conical lower conductive body is shorter than a length of the conical upper conductive body. In the second preferred embodiment, the length of the conical lower conductive body is at least $\lambda_0/4$, wherein $\lambda_0$ is a wavelength when a usable impulse is the minimum frequency. In the second preferred embodiment, the conical lower conductive body may be extended beyond the surface of the dielectric material.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Figure 1:
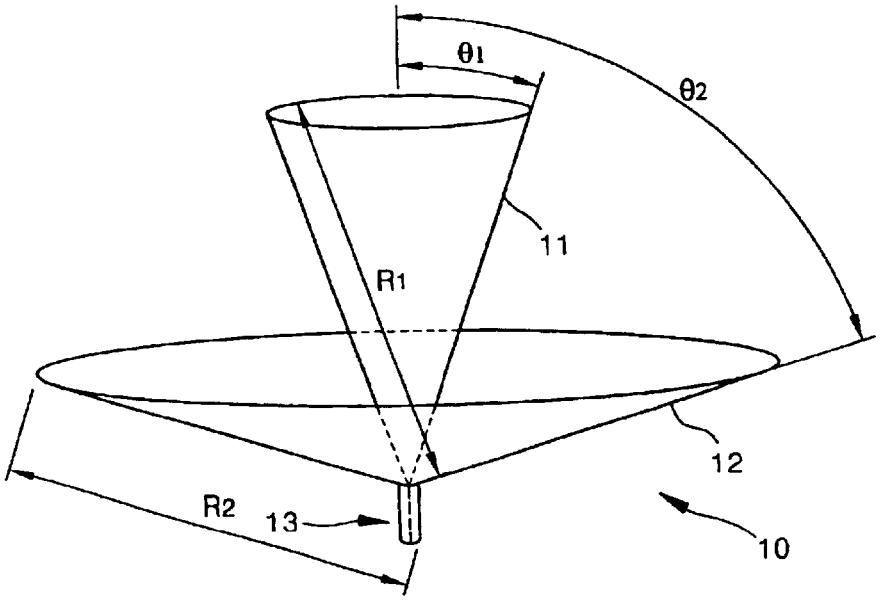
FIG. 1 (PRIOR ART)
FIG. 1 illustrates a perspective view of a basic shape of a biconical antenna.
Figure 2:
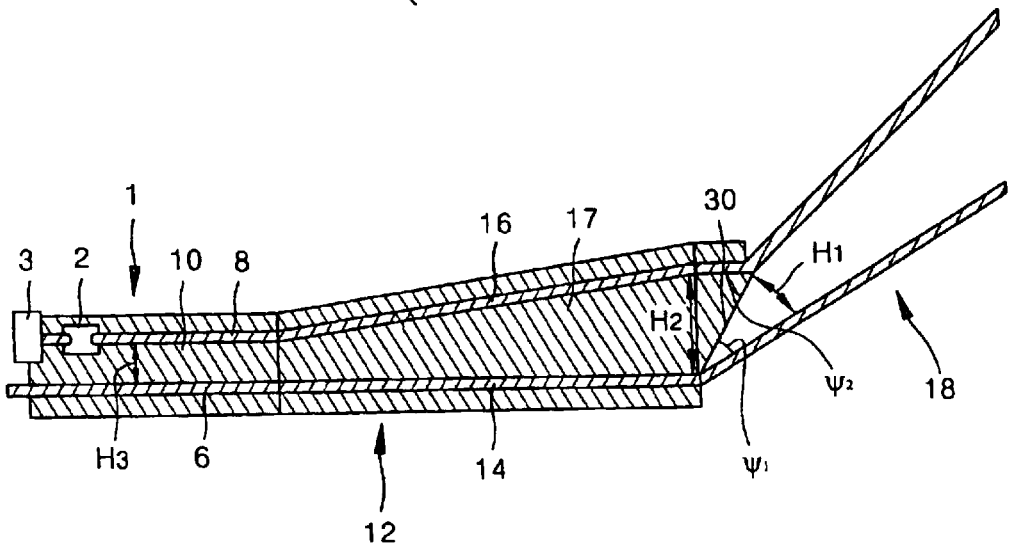
FIG. 2 (PRIOR ART)
FIGS. 2 and 3 illustrate sectional views of conventional biconical antennas.
Figure 3:
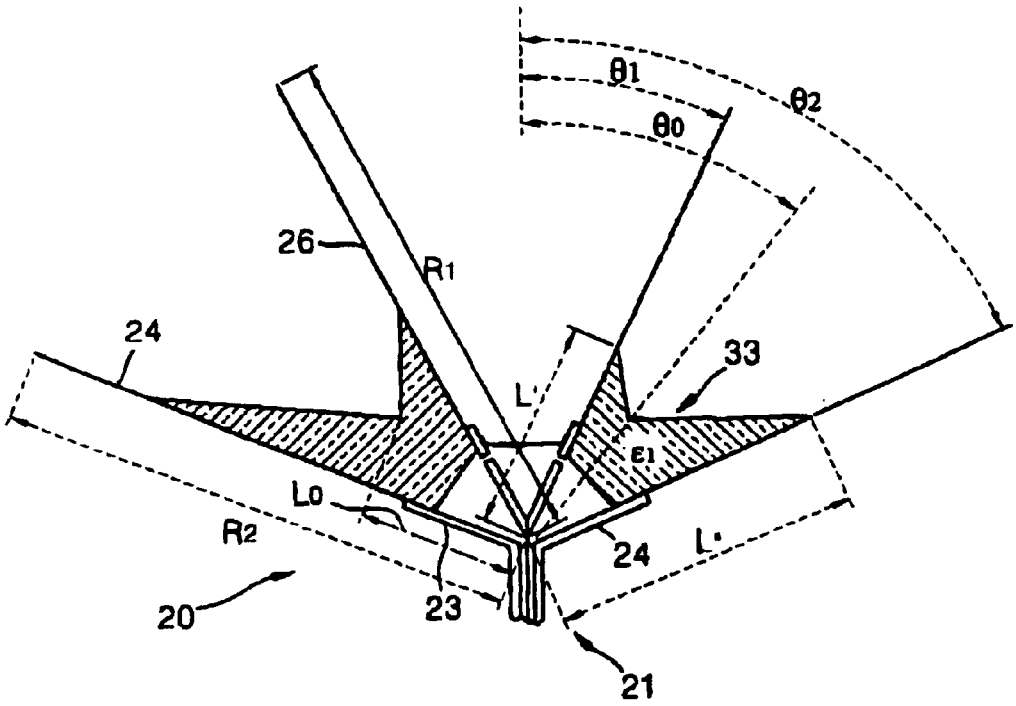
FIG. 3 (PRIOR ART)

Korean Patent Application No. 2002-52463, filed on Sep. 2, 2002, and entitled: "Small and Omni-Directional Biconical Antenna for Wireless Communications," is incorporated by reference herein in its entirety.

The present invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like reference numerals and characters refer to like elements throughout.

An antenna according to an embodiment of the present invention is an impulse transceiving antenna that can be used for communications using an electromagnetic impulse of an ultra-wide band (UWB) and basically has a biconical antenna shape. A dielectric material is inserted between two conical conductive bodies forming the basic structure of a biconical antenna to reduce the physical size of the entire antenna. The dielectric material is injected such that the shortest distance connecting the two conical conductive bodies along a boundary surface between the conductive body and the outer free space, that is, the surface of the conductive body, is preferably a log-spiral curve. Accordingly, an impulse electric field spread from an apex of each of the two conical conductive bodies is always incident on the boundary surface at a Brewster angle. Therefore, the full transmission of the impulse electric field is obtained from the boundary surface so that a full impedance match is obtained between the antenna and an aerial wave.

Figure 4:
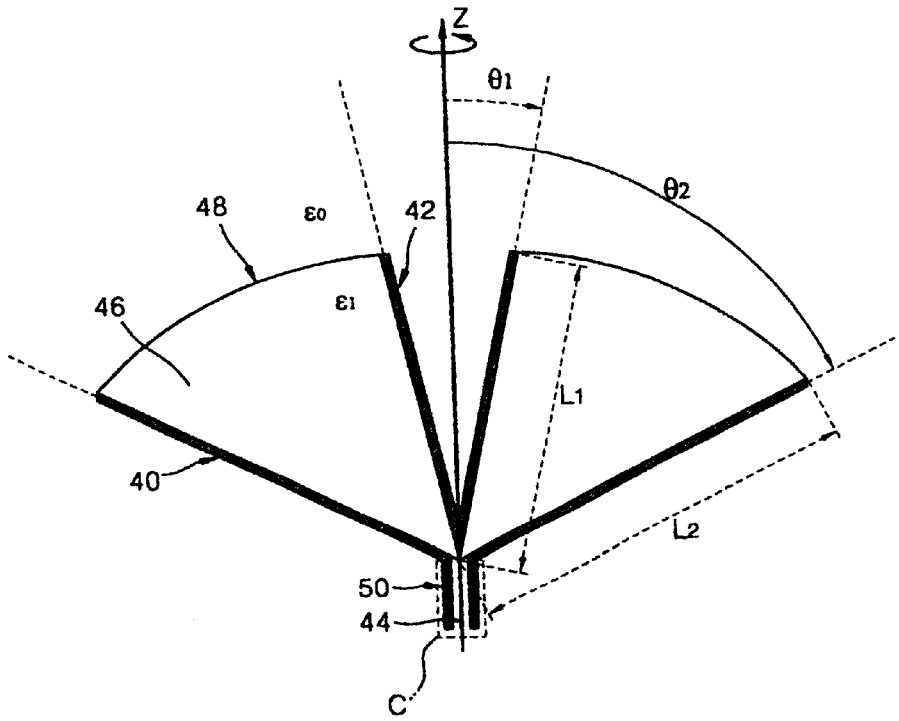
FIG. 4 illustrates a sectional view of a small and omni-directional biconical antenna for mobile communications according to a first preferred embodiment of the present invention.

Referring to FIG. 4, a biconical antenna according to a first preferred embodiment of the present invention includes a coaxial cable C for supplying a power feed including a core wire 44 and an outer wire 50, which is provided around the core wire 44 and insulated from the core wire 44, a conical lower conductive body 40, a conical upper conductive body 42, and a dielectric material 46 completely filling a space between the conical lower and upper conductive bodies 40 and 42. The conical lower and upper conductive bodies 40 and 42 have a common apex, i.e., a common vertex. The coaxial cable C is connected to the conical lower and upper conductive bodies 40 and 42 via the apex, at which point the core wire 44 of the coaxial cable C is connected to the conical upper conductive body 42 and the outer wire 50 is connected to the conical lower conductive body 40. The biconical antenna is designed to have rotation symmetry with respect to a Z-axis, which extends through the common apex and the centers of the conical lower and upper conductive bodies 40 and 42.

In detail, the conical upper conductive body 42 is a structure having rotation symmetry with respect to the Z-axis and has a first length $L_1$. When a spherical coordinate system is used, a position of the conical upper conductive body 42 is set such that $\theta=\theta_1$, where $\theta$ is measured from the Z-axis. The conical lower conductive body 40 is a structure having rotation symmetry with respect to the Z-axis and has a second length $L_2$. When a spherical coordinate system is used, a position of the conical lower conductive body 40 is set such that $\theta=\theta_2$, where $\theta$ is measured from the Z-axis. In the first preferred embodiment of the present invention, the first length $L_1$ measured from the apex is preferably shorter than the second length $L_2$ measured from the apex. In the alternative, in a second preferred embodiment of the present invention, which is described in greater detail below, the second length $L_2$ is preferably shorter than the first length $L_1$. In either preferred embodiment, the shorter length, i.e., the first length $L_1$ in the first preferred embodiment and the second length $L_2$ in the second preferred embodiment, is preferably at least ¼ of the wavelength ($\lambda_0$) of the minimum frequency of a usable impulse frequency, that is, $\lambda_0/4$ or more.

The dielectric material 46, which completely fills the space between the conical lower and upper conductive bodies 40 and 42, is preferably provided to closely contact both the conical lower and upper conductive bodies 40 and 42 from the common apex of the conical lower and upper conductive bodies 40 and 42. The dielectric material 46 has a dielectric constant $\in_1$ of between about 4–50, preferably about 10. The dielectric material 46 may be, e.g., high-density glass, dielectric ceramic, or engineering plastic.

Since the antenna is normally installed in air, the dielectric constant of an external substance outside the dielectric material 46 is considered identical to the dielectric constant $\in_0$ of air. When the antenna is installed in a substance other than air, features of the biconical antenna according to the first preferred embodiment of the present invention do not change significantly.

The shape of a surface of the dielectric material 46 contacting the external substance, for example, air, i.e., the boundary surface, is the most important characteristic of the biconical antenna according to the first preferred embodiment of the present invention. Preferably, the boundary surface of the dielectric material 46 is formed such that an incident angle of a wave incident on the boundary surface inside the dielectric material 46 is the Brewster angle over the entire boundary surface. More specifically, when the conical lower and upper conductive bodies 40 and 42 are cut along the Z-axis, as shown in FIG. 4, a first boundary line 48 divides portions where the dielectric material 46 and the surrounding substance are present. The first boundary line 48 is preferably a curve, for example, a log-spiral curve, that makes an incident angle ($\theta_b$ of FIG. 5) of a wave incident on the first boundary line 48 from inside the first boundary line 48 the Brewster angle over the entire first boundary line 48. That is, in FIG. 5, a sum ($\theta_b+\theta_t$) of the incident angle $\theta_b$ of the incident wave and a refractive angle $\theta_t$ at the first boundary line 48 is 90°. In addition, the first boundary line 48 where the plane including the Z-axis and the dielectric material 46 contact is preferably the log-spiral curve in view of the common apex of the conical lower and upper conductive bodies 40 and 42.

Figure 5:
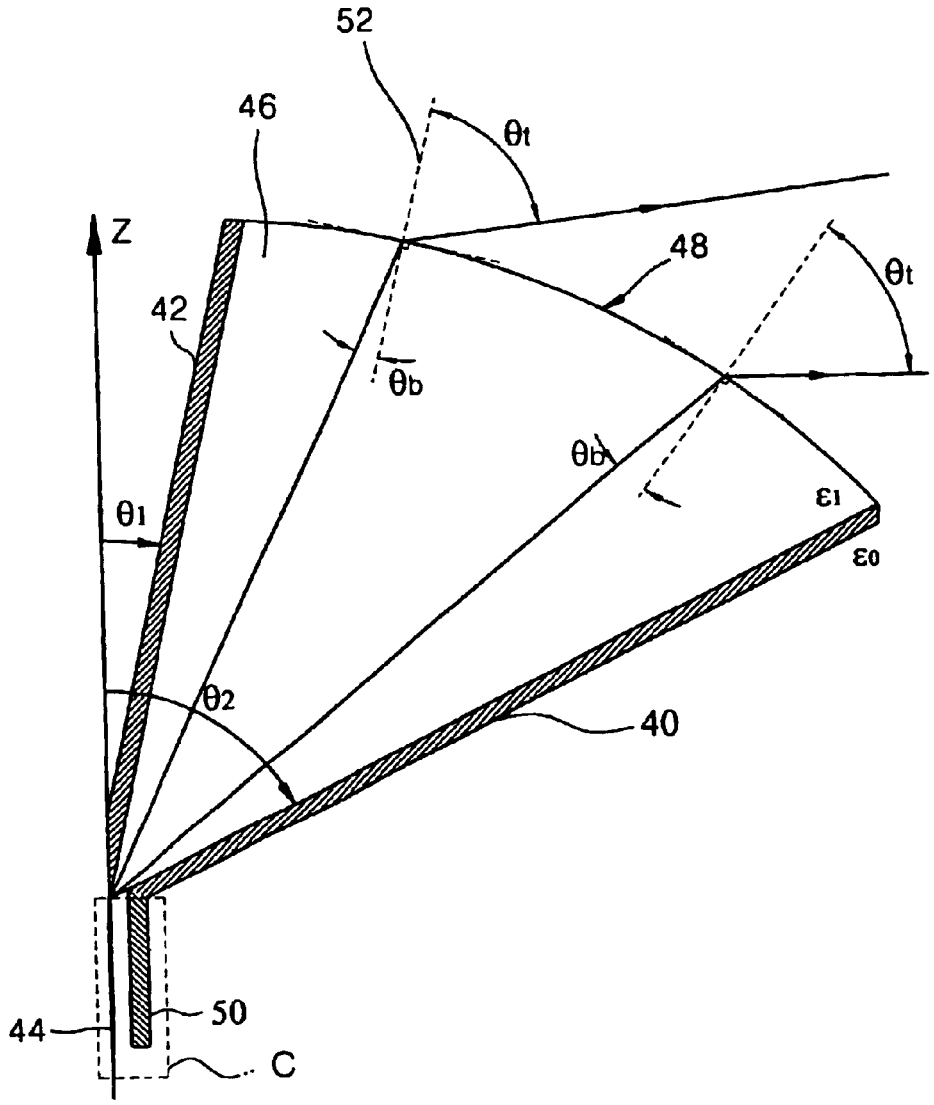
FIG. 5 illustrates a sectional view of the radiation of a wave by the biconical antenna shown in FIG. 4.

Referring to FIG. 5, when an electric wave is incident on a dielectric material (air) having a dielectric constant of $\in_0$ in the dielectric material 46, the Brewster angle $\theta_b$ at which the electric wave is completely transmitted is expressed by Equation 1.

$$\sin\theta_b = \frac{1}{\sqrt{1+\frac{\varepsilon_1}{\varepsilon_0}}} \quad \text{[Equation 1]}$$

Further, the transmission angle $\theta_t$, that is, a refractive angle, is expressed by Equation 2.

$$\sin\theta_i = \sqrt{\frac{\varepsilon_1}{\varepsilon_0}(\sin\theta_b)} \quad \text{[Equation 2]}$$

The electric wave propagated through the dielectric material 46 can be considered as one being radiated from the common apex of the conical lower and upper conductive bodies 40 and 42. Accordingly, the electric wave incident on the boundary surface between the dielectric material 46 and the aerial layer has a directional vector that is a directional vector r of a spherical coordinate system having the origin disposed at the apex. Thus, the first boundary line 48 is defined such that an angle (incident angle) between the directional vector perpendicular to the first boundary line 48 and the directional vector from the apex, that is, the directional vector r of the spherical coordinate system, makes the Brewster angle at any position on the boundary surface 48.

The first boundary line 48 satisfying the above feature, that is, a log-spiral curve, is given by Equation 3:

$$R=\exp[(\pm\tan\theta_b)\theta+a] \quad \text{[Equation 3]}$$

Here, a is a constant and a range of θ is given as $\theta_1 \leqq \theta \leqq \theta_2$. The sign of tangent (tan) in the exponent is "+" when the distance R from the apex increases and "−" when the distance R decreases, as θ increases. In the case of the first boundary line 48 shown in FIGS. 4 and 5, "+" is selected from Equation 3.

Referring to Equation 3, it may be seen that the value of an exponential function is determined by the Brewster angle. Accordingly, when the dielectric constant of the dielectric material 46 is determined, the Brewster angle at the boundary surface between the dielectric material 46 and the air is determined and the shape of the first boundary line 48 may be determined using Equation 3. Since the boundary surface is obtained by rotating the first boundary line 48 with respect to the Z-axis, when the dielectric constant of the dielectric material 46 is determined, the shape of the boundary surface is also determined. In Equation 3, the constant a determines how far the log-spiral curve is separated from the origin as a whole.

The straight line connecting the apex and the first boundary line 48 crosses the first boundary line 48 at a predetermined angle due to the feature of the log-spiral curve. Since the cross angle should be the Brewster angle, when the biconical antenna according to the first preferred embodiment of the present invention is designed, a parameter of the log-spiral curve is preferably selected so that the cross angle is the Brewster angle. The above fact is directly applied to a case in which the first length $L_1$ is longer than the second length $L_2$, i.e., in the second preferred embodiment, which will be described below.

A biconical antenna of the present invention having the conical lower and upper bodies 40 and 42 may be part of a spherical wave guide tube supporting a TEM mode. In that case, a characteristic impedance K of the spherical wave guide tube is expressed as shown in Equation 4:

$$K = \frac{Z}{2\pi}\ln\left(\tan\frac{\theta_2}{2}\cot\frac{\theta_1}{2}\right) \quad \text{[Equation 4]}$$

where $\theta_1$ and $\theta_2$ denote positions of the conical upper and lower conductive bodies 42 and 40 in the spherical coordinate system, respectively. Z is an intrinsic impedance of the dielectric material 46 existing between the conical lower and upper conductive bodies 40 and 42. When the dielectric material 46 is air, the intrinsic impedance Z of the dielectric material 46 is 120 π(Ω).

To remove a reflection wave at the power feed point, the characteristic impedance of the coaxial cable C for feeding electrical power is preferably designed to be the same as the impedance K of the spherical wave guide tube. This may be achieved by appropriately selecting $\theta_2$ and $\theta_1$ that respectively define the positions of the conical lower and upper conductive bodies 40 and 42.

The operation of the biconical antenna according to the first preferred embodiment of the present invention will now be described with reference to FIG. 5.

When an impulse is supplied to the antenna through the coaxial cable C, an electromagnetic wave is radially generated from the common apex of the conical lower and upper conductive bodies 40 and 42. Since the antenna is designed such that the characteristic impedances K of the coaxial cable C and the spherical wave guide tube are identical, impulse reflection does not theoretically exist at the power feed point. The electromagnetic wave radiated from the apex passes through an interior of the dielectric material 46 that fills the space between the conical lower and upper conductive bodies 40 and 42 and is incident on the first boundary line 48. The incident angles of the electromagnetic wave at all points on the first boundary line 48 are the Brewster angles. Thus, the reflectance of the electromagnetic wave, that is, the impulse, incident on the first boundary line 48 is zero (0). This means that all the impulses radiated from the apex and incident on the first boundary line 48 pass through the first boundary line 48. Since the dielectric constant $\in_1$ of the dielectric material 46 is greater than the dielectric constant $\in_0$ of air, like an electromagnetic wave progressing from a relatively denser medium to a relatively lighter medium, the electromagnetic wave passing through the first boundary line 48 to travel from the dielectric material 46 to the air is refracted at an angle $\theta_t$ greater than an incident angle $\theta_b$ on the first boundary line 48, that is, the Brewster angle. Also, as shown in FIG. 5, since the dielectric material 46 is inclined by $\theta_1$ with respect to the Z-axis and the length of the conical upper conductive body 42 is shorter than that of the conical lower conductive body 40, the electromagnetic wave incident on the first boundary line 48 is input from the left side of a normal line 52 perpendicular to the first boundary line 48 and refracted to the right side of the normal line 52. Accordingly, the electromagnetic wave passing through the first boundary line 48 is radiated in the air in all directions with respect to the Z-axis. That is, the electromagnetic wave passing through the first boundary line 48 is omni-directional on an X-Y plane perpendicular to the Z-axis.

Figure 6:
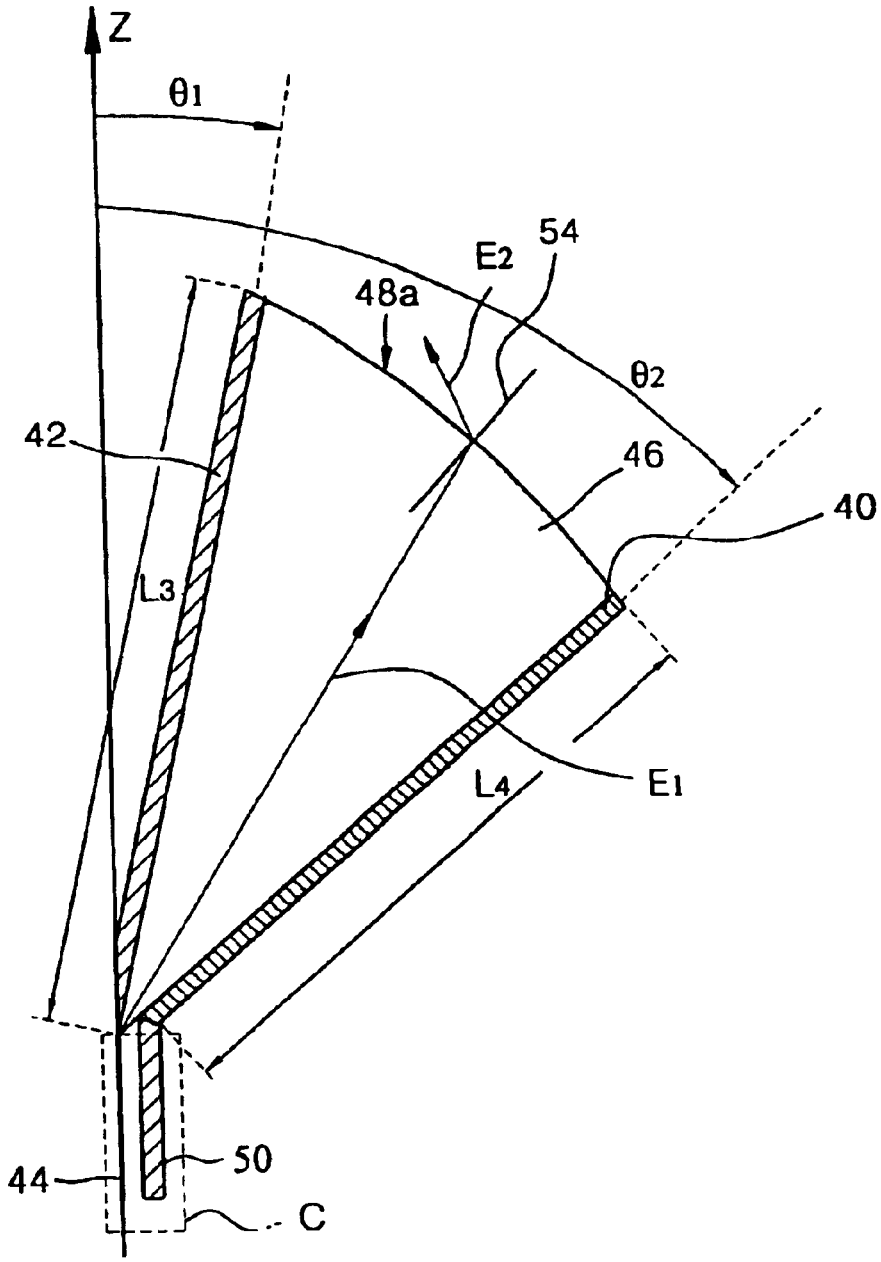
FIG. 6 illustrates a sectional view of a case in which the lengths of the conical upper conductive body and conical lower conductive body of the biconical antenna shown in FIG. 4 are reversed according to a second preferred embodiment of the present invention.

In a biconical antenna according to a second preferred embodiment of the present invention, which is shown in FIG. 6, the relative lengths of the conical upper and lower conductive bodies 42 and 40 may be reversed from the arrangement in the first preferred embodiment.

Referring to FIG. 6, the conical upper and lower conductive bodies 42 and 40 have a third length $L_3$ and a fourth length $L_4$, respectively, wherein the third length $L_3$ is longer than the fourth length $L_4$. Preferably, the fourth length $L_4$ in the second preferred embodiment is the same as the first length $L_1$ in the first preferred embodiment and the third length $L_3$ in the second preferred embodiment is the same as the second length $L_2$ in the second preferred embodiment Accordingly, the fourth length $L_4$ is preferably at least $\lambda_0/4$.

Reference numeral 48*a* denotes a second boundary line where the dielectric material 46 filling a space between the conical upper and lower conductive bodies 42 and 40 contacts air. The second boundary line 48*a* is preferably a curve where the incident angle of a wave incident on the second boundary line 48*a* is the Brewster angle at any point on the second boundary line 48*a*, which is similar to the first boundary line 48 as shown in FIG. 4 or 5. For example, the second boundary line 48*a* is a log-spiral curve. In the case of the second boundary line 48*a*, however, an electromagnetic wave $E_1$ incident on the second boundary line 48*a* is incident from the right side of a normal line 54 perpendicular to the second boundary line 48*a* and refracted to the left side of the normal line 54 after passing through the second boundary line 48*a*. Since the refraction angle is much greater than the incident angle, unlike in the case of being refracted after passing through the first boundary line 48, the electromagnetic wave $E_2$ that is refracted after passing through the second boundary line 48*a* proceeds toward the Z-axis. This means that, when the length of the conical upper conductive body 42 is greater than that of the conical lower body 40, the radiation pattern of the biconical antenna according to the present invention has directivity toward the Z-axis.

Figure 7:
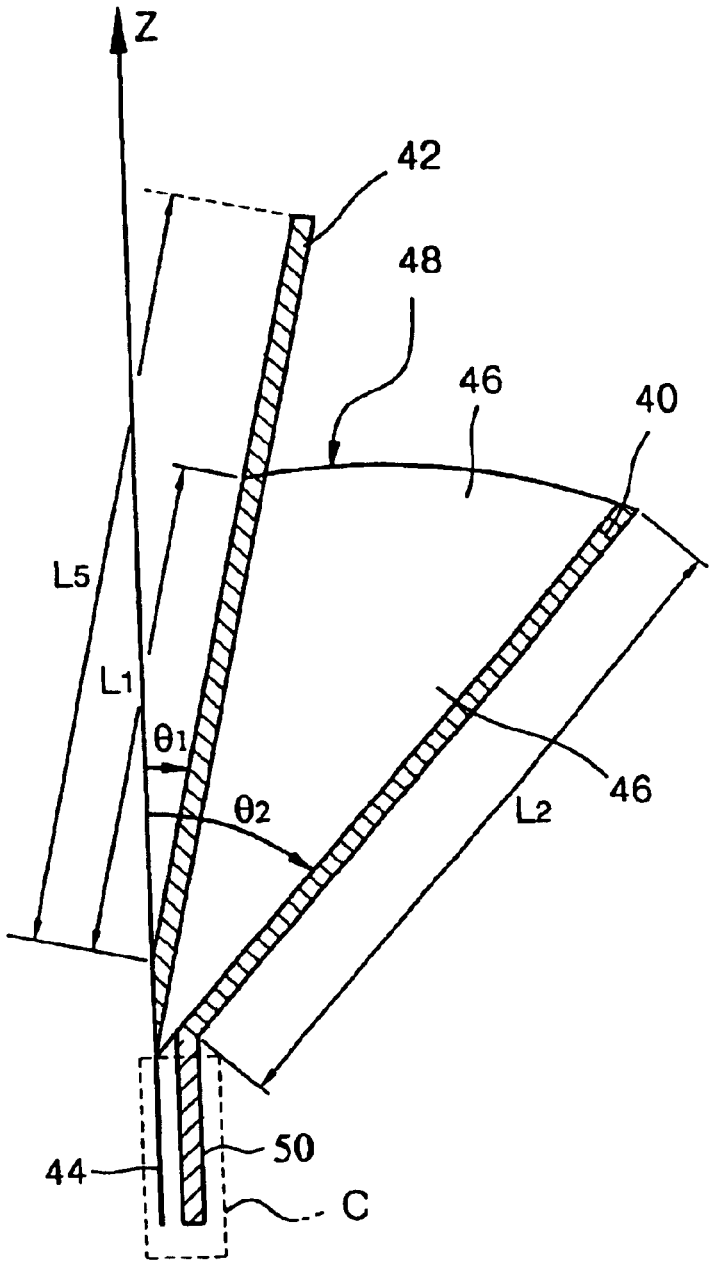
FIG. 7 illustrates a partial sectional view of a case in which a length of the conical upper conductive body of the biconical antenna shown in FIG. 4 is extended.
Figure 8:
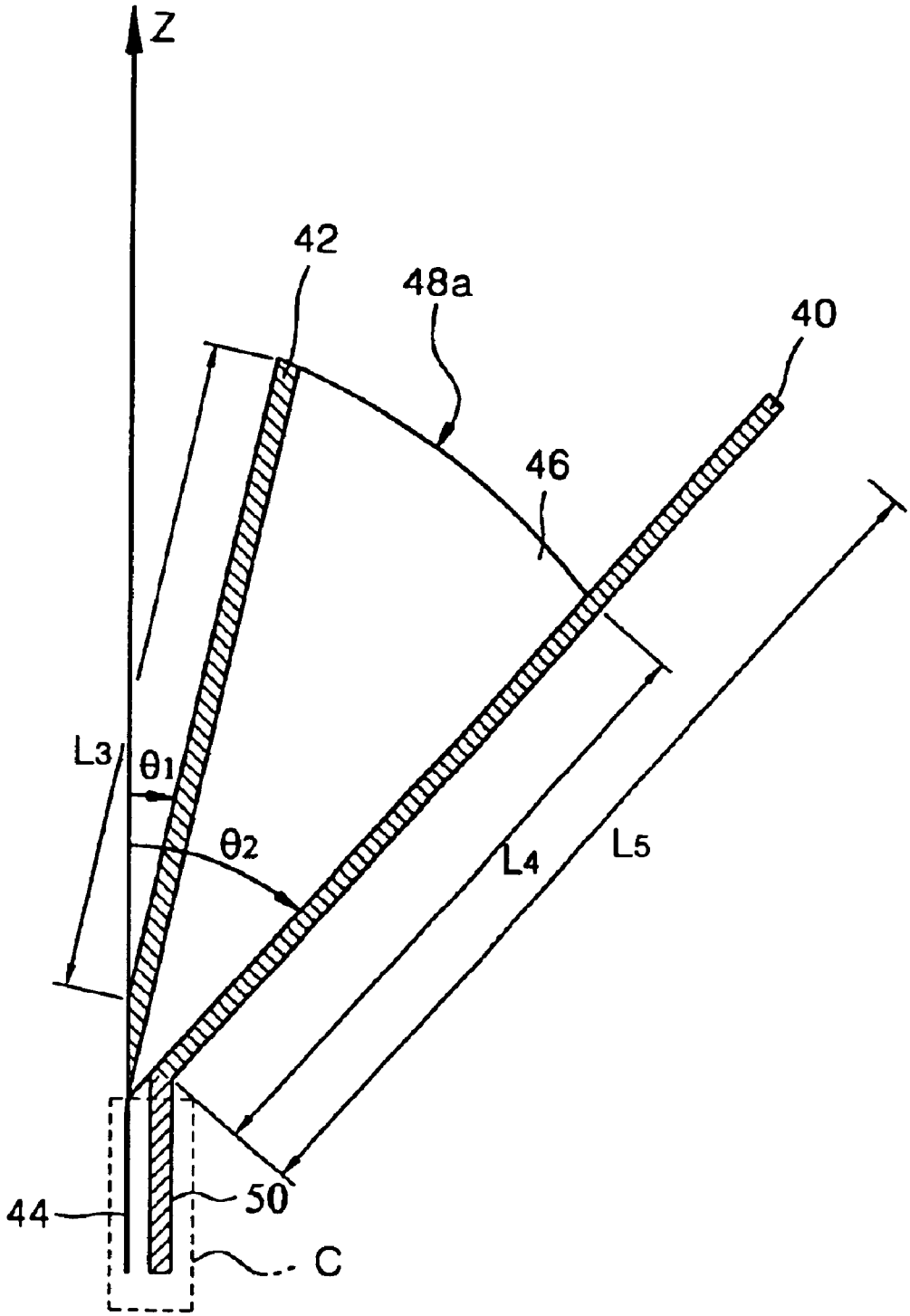
FIG. 8 illustrates a partial sectional view of a case in which a length of the conical lower conductive body of the biconical antenna shown in FIG. 6 is extended.

In some cases, the conical lower conductive body 40 or the conical upper conductive body 42 may be extended further than as shown in FIGS. 5 and 6, as shown in FIGS. 7 and 8.

For example, as shown in FIGS. 4 and 5, when the length of the conical upper conductive body 42 is shorter than that of the conical lower body 40 (hereinafter, referred to as the first case), the electromagnetic wave is radiated in all directions with respect to the Z-axis. Accordingly, when the length of the conical upper conductive body 42 is at least $\lambda_0/4$, the length of the conical upper conductive body 42 does not affect the proceeding direction of the electromagnetic wave. Thus, in the first case, as shown in FIG. 7, the length of the conical upper conductive body 42 can be extended to a fifth length $L_5$ that is longer than the first and second lengths $L_1$ and $L_2$.

However, as shown in FIG. 6, when the length of the conical upper conductive body 42 is longer than that of the conical lower body 40 (hereinafter, referred to as the second case), the electromagnetic wave $E_2$ radiated in the air is directed toward the Z-axis. Accordingly, when the length of the conical lower conductive body 40 is at least $\lambda_0/4$, the length of the conical lower conductive body 40 does not affect the proceeding direction of the electromagnetic wave $E_2$. Thus, in the second case, the length of the conical lower conductive body 40 can be extended to the fifth length $L_5$ that is longer than the third and fourth lengths $L_3$ and $L_4$, as shown in FIG. 8.

As described above, in the biconical antenna according to the present invention, the space between the conical upper and lower conductive bodies is completely filled with a dielectric material such that the surface of the dielectric material contacting the external substance, for example, air, forms a curve, for example, a log-spiral curve, at which a boundary line between the dielectric material and the external substance, which is formed when the antenna is cut along the center of the antenna, makes a reflectance to the incident wave zero.

As a result, the biconical antenna according to an embodiment of the present invention has the following advantages.

First, a size of the biconical antenna may be greatly reduced so that it may be applied to terminals for mobile communication. In detail, referring back to FIG. 4, assuming that the wavelength of an impulse in the air which is radiated through the dielectric material 46 from the common apex of the conical lower and upper conductive bodies 40 and 42 is $\lambda_1$ and the wavelength of the impulse in the dielectric material 46 is $\lambda_2$, $\lambda_2$ is the same as a result obtained by dividing $\lambda_1$ by $$\sqrt{\frac{\varepsilon_1}{\varepsilon_0}}.$$

Here, since $$\sqrt{\frac{\varepsilon_1}{\varepsilon_0}}$$

is greater than 1, $\lambda_2$ is shorter than $\lambda_1$. Accordingly, the width of the impulse in the dielectric material 46 is shortened at the same rate.

The length of the conical upper conductive body 42 in the first case and the length of the conical lower conductive body 40 in the second case are at least ¼ of $\lambda_0$. Thus, when $\lambda_2$ is $\lambda_0$, the size of the biconical antenna according to the present invention decreases as much as the conventional biconical antenna in which the space between the conical upper and lower conductive bodies is divided by $$\sqrt{\frac{\varepsilon_1}{\varepsilon_0}}.$$

For example, when a dielectric substance in which the ratio of dielectric constant $$\left(\frac{\varepsilon_1}{\varepsilon_0}\right)$$

is 9 is used as the dielectric material 46, the size of the biconical antenna according to the present invention is reduced by ⅓ as compared to a conventional antenna.

Second, when the biconical antenna according to an embodiment of the present invention is used, a radiation pattern having omni-directivity on a horizontal surface (X-Y plane) as shown in FIG. 4 can be obtained. The radiation pattern is necessary for an antenna for a mobile communication terminal, which can guarantee transceiving quality regardless of the direction of the terminal during transceiving.

Third, by using the biconical antenna according to an embodiment of the present invention, a mobile communication terminal suitable for ultra-wideband impulse communications can be realized. More particularly, the biconical antenna has an ultra-wideband. Since the center of phase is not a function of frequency, a phenomenon in which time delay changes by frequency when an impulse is transmitted and received disappears so that the shape of the impulse is not distorted. Thus, the biconical antenna according to the present invention is suitable for an antenna for ultra-speed wireless communications.

Preferred embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims. For example, those skilled in the art may adopt different power feed methods while retaining the structure of the conical upper and lower conductive bodies and the dielectric material. In addition, the dielectric material may be injected such that the boundary line, which appears when the dielectric material is cut in a state in which the lengths of the conical upper and lower conductive bodies are maintained to be the same, is a log-spiral curve.

What is claimed is:

1. A biconical antenna for wireless communications, comprising:

a conical upper conductive body and a conical lower conductive body having a common apex, which is used as a power feed point, wherein a space between the conical upper and lower conductive bodies is filled with a dielectric material having a curved boundary surface such that an incident angle of an incident wave incident on the boundary surface of the dielectric material through the dielectric material from the common apex is a Brewster angle over the entire boundary surface of the dielectric material.

2. The biconical antenna as claimed in claim 1, wherein the curved boundary surface is a log-spiral curved boundary surface.

3. The biconical antenna as claimed in claim 1, wherein a dielectric constant of the dielectric material is between about 4–50.

4. The biconical antenna as claimed in claim 1, wherein the dielectric material is selected from the group consisting of high-density glass, dielectric ceramic, and engineering plastic.

5. The biconical antenna as claimed in claim 1, wherein a length of the conical upper conductive body is shorter than a length of the conical lower conductive body.

6. The biconical antenna as claimed in claim 5, wherein the length of the conical upper conductive body is at least $\lambda_0/4$, wherein $\lambda_0$ is a wavelength when a usable impulse is the minimum frequency.

7. The biconical antenna as claimed in claim 5, wherein the conical upper conductive body is extended beyond the curved boundary surface of the dielectric material.

8. The biconical antenna as claimed in claim 1, wherein a length of the conical lower conductive body is shorter than a length of the conical upper conductive body.

9. The biconical antenna as claimed in claim 8, wherein the length of the conical lower conductive body is at least $\lambda_0/4$, wherein $\lambda_0$ is a wavelength when a usable impulse is the minimum frequency.

10. The biconical antenna as claimed in claim 8, wherein the conical lower conductive body is extended beyond the curved boundary surface of the dielectric material.

11. A biconical antenna for wireless communications, comprising:

a conical upper conductive body and a conical lower conductive body having a common apex, which is used as a power feed point, wherein a space between the conical upper and lower conductive bodies is filled with a dielectric material selected from the group consisting of high-density glass, dielectric ceramic, and engineering plastic.

12. A biconical antenna for wireless communications, comprising:

a conical upper conductive body and a conical lower conductive body having a common apex, which is used as a power feed point, wherein a space between the conical upper and lower conductive bodies is filled with a dielectric material, and a length of the conical upper conductive body is different than a length of the conical lower conductive body, the length of a longer of the conical upper conductive body and the conical lower conductive body is at least $\lambda_0/4$, wherein $\lambda_0$ is a wavelength when a usable impulse is the minimum frequency.

13. The biconical antenna as claimed in claim 12, wherein the length of the conical upper conductive body is longer than the length of the conical lower conductive body.

14. The biconical antenna as claimed in claim 12, wherein the length of the conical lower conductive body is longer than the length of the conical upper conductive body.

* * * * *